United States Patent [19]

Artzt et al.

[11] Patent Number: 4,769,981

[45] Date of Patent: Sep. 13, 1988

[54] PROCESS AND DEVICE TO PIECE TO A SPINNING DEVICE

[75] Inventors: Peter Artzt; Harald Dallmann, both of Reutlingen; Kurt Ziegler, Kirchheim-Nabern; Gerhard Egbers, Reutlingen, all of Fed. Rep. of Germany

[73] Assignee: Schubert & Salzer, Ingolstadt, Fed. Rep. of Germany

[21] Appl. No.: 82,631

[22] PCT Filed: Sep. 2, 1986

[86] PCT No.: PCT/DE86/00351

§ 371 Date: Aug. 26, 1987

§ 102(e) Date: Aug. 26, 1987

[87] PCT Pub. No.: WO87/03309

PCT Pub. Date: Jun. 4, 1987

[30] Foreign Application Priority Data

Nov. 21, 1985 [DE] Fed. Rep. of Germany ..... 3541220

[51] Int. Cl.[4] ..... D01H 15/00

[52] U.S. Cl. ..... 57/261; 57/22

[58] Field of Search ..... 57/22, 261, 263, 279, 57/328, 280, 333, 351

[56] References Cited

U.S. PATENT DOCUMENTS 3,992,865 11/1976 Tuchida et al. ..... 57/328
4,438,621 3/1984 Rohner ..... 57/333 X
4,485,615 12/1984 Pigalev et al. ..... 57/261
4,517,794 5/1985 Sakai et al. ..... 57/261 X
4,545,193 10/1985 Tanaka et al. ..... 57/261
4,550,560 11/1985 Tanaka et al. ..... 57/261
4,631,912 12/1986 Hardy ..... 57/261 X

FOREIGN PATENT DOCUMENTS 3235769 7/1983 Fed. Rep. of Germany .
3237990 8/1983 Fed. Rep. of Germany .
1582306 1/1981 United Kingdom .

*Primary Examiner*—Donald Watkins
*Attorney, Agent, or Firm*—Dority & Manning

[57] ABSTRACT

In a spinning device of the type equipped with a torsion element having an injector nozzle and a torsion nozzle which are separated from each other during spinning by a gap which is open to the atmosphere, yarn is threaded for piecing into such torsion element, which is brought into a threading position. Threading is effected with the assistance of negative pressure which is applied to the torsion element from the side thereof which constitutes its inlet side during normal spinning. The gap between the injector and torsion nozzles is sealed against the atmosphere before threading of the yarn. Thereafter, and at the latest at the beginning of the withdrawal of the pieced yarn, the gap is opened once more. A sealing device, which may assume various alternative constructions, is provided to carry out the process by sealing the gap between the injector nozzle and the torsion nozzle during the threading phase.

19 Claims, 3 Drawing Sheets

PROCESS AND DEVICE TO PIECE TO A SPINNING DEVICE

BACKGROUND AND SUMMARY OF THE INVENTION

The instant invention relates to a process to piece to a spinning device following yarn breakage, using a pneumatic torsion device with an injection component which is separated from a torsion component by a gap open to the atmosphere, in which the yarn is threaded into the pneumatic torsion device from the outlet side, with the help of negative pressure, and to a device to carry out said process.

According to a known process, the yarn is sucked from the side opposite to the draw-off rolls through the torsion nozzle brought into threading position (see German published application No. 3,411,577 corresponding with U.S. Pat. Nos. 4,550,560 and 3,413,894 corresponding with U.S. Pat. No. 4,545,193). In this case for spinning only a single nozzle is used which not in every case leads to acceptable results with respect to the spun yarn.

For the production of bulky yarn it is also already known to provide an injector nozzle in front of the torsion nozzle, those two nozzles being arranged one relative to the other in such a manner that a gap exists between them (See German published application No. 3,237,990). Since air enters through this gap, strong negative pressure is required in the two nozzles for the threading of the yarn.

It is therefore the object of the instant invention to create a process and a device which make it possible to thread the yarn into the nozzles, separated from each other by an air gap, in a simple manner and with low air consumption.

This object is achieved according to the invention in that the gap is sealed against the atmosphere before threading of the yarn, the yarn is then threaded into the torsion element in opposite direction to the draw-off direction and the gap is laid open again, at the latest at the beginning of draw-off of the pieced yarn. By sealingly closing the gap before threading, the negative pressure applied to the mouth which constitutes the inlet side during normal spinning of the torsion element can exert its full force at the mouth of the torsion element which constitutes the outlet side during normal spinning. The intensity is thus unaffected by extraneous air penetrating through the gap. With the gap being covered, the yarn is again threaded into the torsion element and is combined with the fiber sliver or roving being fed to the machine. The gap is laid open before or during piecing, at the latest when draw-off of the pieced yarn begins, so that the withdrawal of the yarn is not affected.

In a simple embodiment of the process of the invention, sealing of the gap can be effected by covering it. In this case it is possible to utilize the movement of the torsion element from its spinning position into a threading position and to seal the gap through the transfer of the torsion element into its threading position. However, an axial movement of the injector nozzle and/or of the torsion nozzle can also be produced for this purpose, so that the gap is closed by the relative axial movement of injector nozzle and torsion nozzle.

To carry out the described process the invention provides for the utilization of a sealing device which can be associated to the gap between injector nozzle and torsion nozzle during the threading phase, so as to prevent penetration of extraneous air into the interior of the torsion nozzle.

The sealing device is advantageously formed as a screen which can be associated to the gap. In an advantageous embodiment of this device according to invention, the torsion element is provided with an elastic element by means of which it is held against a stop determining the spinning position, while the screen associated to the gap is also used as a driving device by means of which the torsion element can be brought into the threading position. The torsion element can be supported pivotably and can be applied sealingly against the screen through swivelling around its swivelling axle.

The screen can take various forms and can be associated to the gap in different ways. For example, a stationary screen can be provided, whereby the gap can be associated to it for sealing closure through the movement of the torsion element from its spinning position into its threading position.

Sealing of the gap is also possible if the torsion nozzle and the injector nozzle can be brought into contact with each other through axial shifting of at least one of these two nozzles so that the gap between the two nozzles is closed.

Another advantageous embodiment of the object of the invention provides for the torsion nozzle and/or the injector nozzle to be equipped with a sleeve-like screen which can be brought by axial shifting into a position covering the gap between torsion element and injector nozzle.

In an especially simplified and advantageous embodiment of the device according to invention, the suction pipe can be pressed against the inlet side of the torsion element in such a manner that the gap between the injector nozzle and the torsion nozzle is closed. Depending upon the design of the object of the invention, the suction pipe either presses the elastically supported injector nozzle against the torsion nozzle or pushes the sleeve-like, also elastically supported screen to a point beyond the gap between injector nozzle and torsion nozzle.

By means of the process of the invention and of the device made in accordance with the invention, threading of the yarn into the torsion element can be carried out in a simple manner with the help of relatively little negative pressure and therefore economically. Since the aspiration of extraneous air through the gap between injector nozzle and torsion nozzle is eliminated, the threading negative pressure is exerted with full intensity upon the outlet side (during normal spinning) of the torsion element.

BRIEF DESCRIPTION OF THE DRAWINGS

Examples of embodiments are illustrated in further detail through the drawings, in which.

Figure 1:
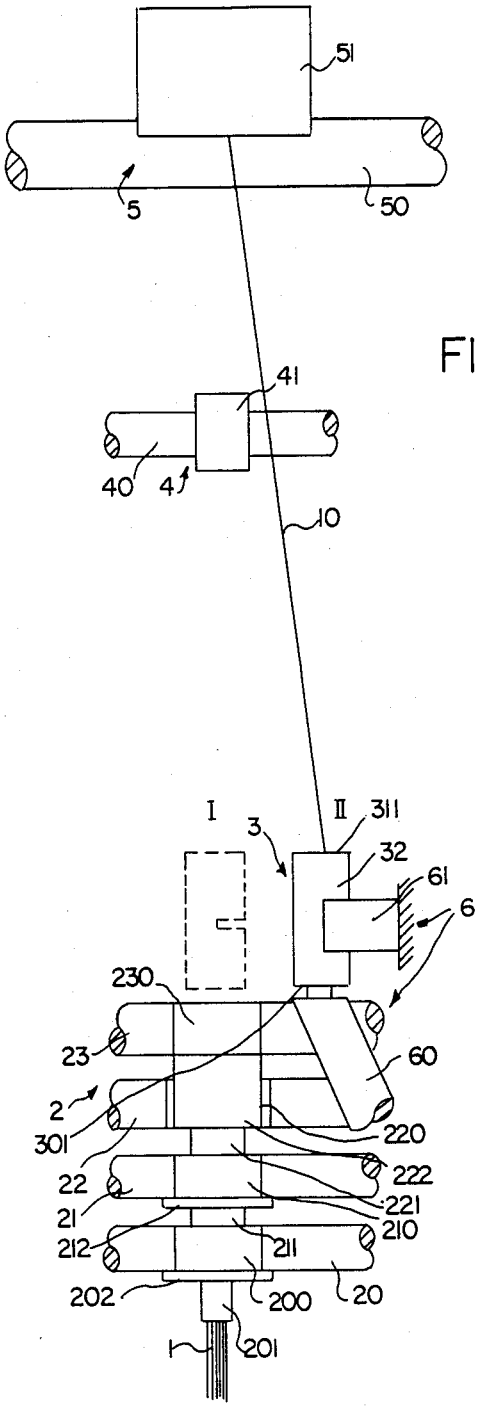
FIG. 1 is a schematic front view of a spinning device according to the invention, in threading position.

Repeat use of reference characters throughout the drawings and specification is intended to represent same or analogous features or aspects of the invention.

DETAILED DESCRIPTION OF THE PREFERRED EMBODIMENTS

The spinning device described first through FIG. 1 has as its essential elements a drafting mechanism 2, a torsion element 3, a draw-off device 4, a winding device 5, and a threading device 6.

In accordance with FIG. 1 the drafting mechanism 2 has four pairs of rolls, with rolls 20 and 200, 21 and 210, 22 and 220 as well as 23 and 230, whereby the rolls 22, 220 are equipped with small belts 222. Compressors 201, 211, and 221 are installed in front of the rolls 20, 200, between the rolls 21, 210 and 20, 200 and between the rolls 21, 210 and 22, 220, respectively. A clamping device 202 or 212 for the roving is furthermore installed in front of the rolls 20, 200 and in front of the rolls 21, 210 respectively.

Figure 4:
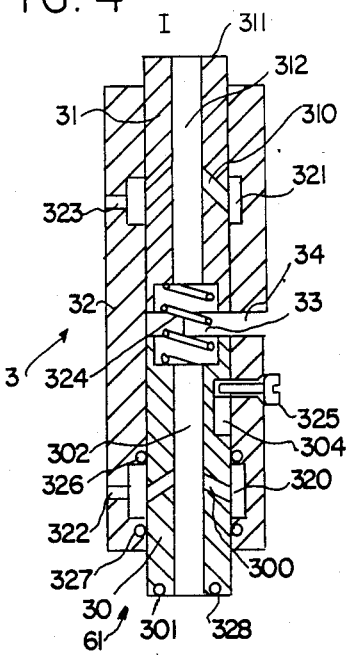
FIGS. 4 and 5 are longitudinal sections of a torsion element with axially mobile injector nozzle in spinning and in threading position, respectively
Figure 5:
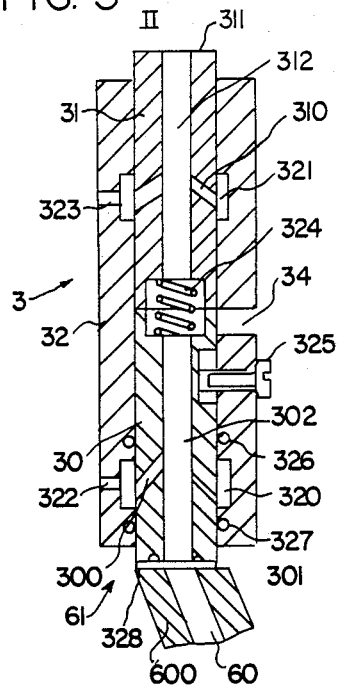
Figure 6:
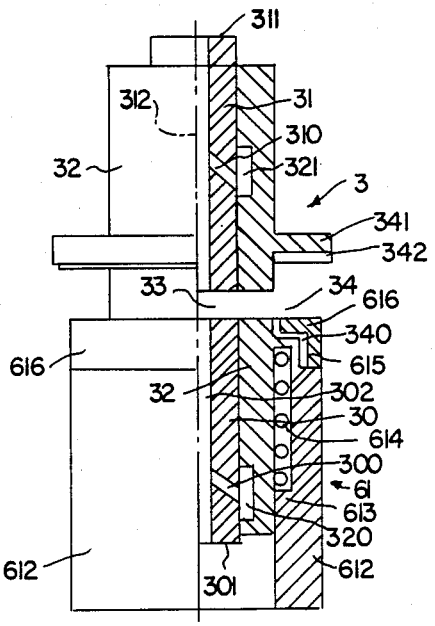
FIG. 6 is a variation of the torsion element shown in FIGS. 4 and 5, in spinning position.

As can be seen from FIGS. 4 to 6, the torsion element 3 is equipped with an injector nozzle 30 as well as with a torsion nozzle 31 which are provided with compressed air openings 300 and 310 respectively to admit compressed air. The injector nozzle 30 and the torsion nozzle 31 are installed in a holding device 32 which is provided with ring channels 320 and 321 with which the compressed air openings 300 or 310 are connected. The ring channels 320 and 321 are connected to a source of negative pressure (not shown) via lines 322 and 323.

The injector nozzle 30 and the torsion nozzle 31 are installed at an axial distance from each other so that a gap 33 remains between them. This gap 33 between the injector nozzle 30 and the torsion nozzle 31 is connected to the atmosphere via a gap 34 in the holding device 32.

The draw-off device 4, as shown in FIG. 1, is equipped in the usual manner with a driven draw-off roll 40 and with a pressure roll 41 interacting elastically with said draw-off roll 40.

The winding device 5 is equipped with a driven winding roll 50 which drives the conventionally supported bobbin 51.

Other conventional means such as a yarn oscillating device, yarn tension compensating bar, yarn monitor etc. have not been shown in FIG. 1 for the sake of simplification.

A suction pipe 60 and a sealing device 61, by means of which the gap 33 between the injector nozzle 30 and the torsion nozzle 31 can be closed sealingly against the atmosphere, are shown in FIG. 1 as the most essential elements of the threading device 6.

The operation of the device, the composition of which is described above, is explained below:

During undisturbed spinning operation, a fiber sliver or roving 1 is fed to the drafting mechanism 2, is stretched by said drafting mechanism 2 to the desired thickness for the spun yarn 10, and is then fed to the torsion element 3. In this process the fiber ends of the outer fibers spread away from the fed small sliver. By means of the compressed air which is fed to it, the torsion element 3 causes the free fiber ends of the small sliver being fed to the injector nozzle 30 to loop around the yarn core. The yarn core is given a certain amount of false twist, which is again undone to a great extent afterwards, in the torsion element 3. In the course of false twist and undoing thereof, the fiber ends are incorporated into the yarn core and thus ensure that the spun yarn 10 will be of desired strength.

The spun yarn 10 is drawn off by the draw-off device 4 from the torsion element 3 and is fed to the winding device 5 to be wound on the bobbin 51.

If the yarn breaks, a signal is given in a known manner by a yarn monitor (not shown), causing the two clamping devices 202 and 212 for the roving to be activated. The roving 1 is thereby stopped in front of the rolls 20, 200 and 21, 210. The portion of the roving following these rolls is separated from the stopped portion of the roving through continued running of the rolls 22, 220 and 23, 230 and is fed to a suction mechanism (not shown) so that clogging of the torsion element 3 by fiber material which is no longer drawn off from said torsion element 3 is avoided.

For piecing, the torsion element 3 is brought from its spinning position I into its threading position II. The holding device 32 comes to lie against stop 61 in such a manner that the latter covers the gap 34 which extends merely over a portion of the circumference of said holding device 32.

The yarn end which is on bobbin 51 is located and is drawn off from said bobbin 51 through reverse rotation of said bobbin 51 and removal by suction. The yarn end is then presented to the side of the torsion element 3 which constitutes its outlet side 311 during normal spinning operation. The suction pipe 6 is furthermore brought before the side of torsion element 3 which constitutes its inlet side 301 during normal spinning operation.

Negative pressure is now produced inside suction pipe 6 while the yarn 10, possibly after a short interruption, is now back-fed from bobbin 51. The negative pressure prevailing inside suction pipe 6 takes its full effect at the outlet side 311 of the torsion element 3, where the yarn end is located. The yarn 10 is thus sucked through the torsion element and into the suction pipe 6.

When the back-fed yarn end has extended sufficiently far into the suction pipe 6, yarn back-feeding is stopped and the torsion element 3 is moved back into its spinning position I, whereby the gap 34 is uncovered again by the sealing device 61.

Through coordinated release of the roving 1 by the clamping devices 202 and 212 for the roving, through the resumption of air feeding through the compressed air openings 300, 310 into the interior of the torsion element 3 and through the beginning of winding and yarn draw-off (which may be delayed somewhat in relation to winding), the yarn 10 is combined with the roving 1 and the normal spinning process is thus resumed.

Through the reopening of the gap 33 between the injector nozzle 30 and the torsion nozzle 31 as well as of the gap 34 in the holding device 32 when draw-off of the spun yarn 10 by bobbin 51 begins, and possibly also by the draw-off device 4, the air required for the spinning process can be sucked through the gap 33/34 into the interior of the torsion element 3.

Figure 2:
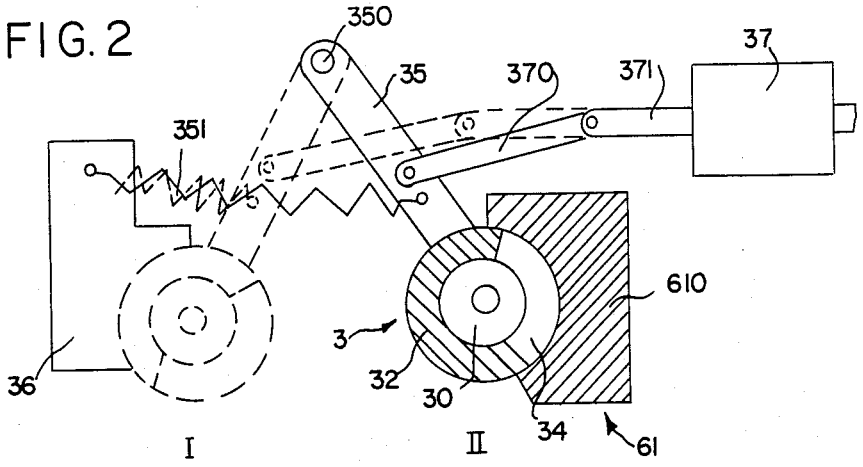
FIG. 2 is a top view and partial section of a special design of the device shown in FIG. 1, in spinning or threading position, respectively.

The sealing device 61 shown in FIGS. 1 and 2 is provided with a screen 610 which is fixedly supported and to which the torsion element 3 is associated through its movement from spinning position I into threading position II. The details of a particularly advantageous example of an embodiment of the invention are now explained through FIG. 2. The holding device 32 is here supported on a swivelling lever 35, capable of being swivelled around a bearing bolt 350.

A first stop 36 is associated to the torsion element 3. The swivelling lever 35 is subjected to the pull of a tension spring 351, one end of which is attached to the swivelling lever 35 and the other end of which is attached to the stop 36. The torsion element 3 is thus normally held by tension spring 351 in contact with the stop 36 which is designed so that the torsion element 3 which touches it assumes spinning position I. In this position, the gap 34 is not covered by the stop 36.

The swivelling lever 35 is connected via a coupling 370 to the anchor 371 of a solenoid 37. When the solenoid 37 is excited, the torsion element 3 is brought, in opposition to the force exerted by tension spring 351, from the spinning position I into the threading position II, thus being applied against the screen 610 which is formed as a stop, so that the gap 33/34 is sealed against the atmosphere in this position. When the back-fed yarn 10 has been threaded into the torsion element 3, said torsion element 3 is released again as the excitation of solenoid 37 stops and returns into its spinning position I in which it is once more in contact with the stop 36.

The invention is not limited to the embodiments described, but can be varied in many ways, in particular through the replacement of features by equivalents or through different combinations thereof. Such a variant of the sealing device 61 is explained below through FIG. 3. In this embodiment, too, the gap 33/34 is sealed by being covered. The torsion element 3 is, as shown in FIG. 2, pulled by a tension spring 351 which is fixedly attached at a suitable location. The swivelling lever 35 is equipped with a second arm 352 which is held in contact with the stationary stop 38 determining the spinning position I of the torsion element 3, under the effect of the tension spring 351.

The sealing device 61 which can be associated to the gap 34 of the torsion element 3 is provided with a screen 611 which constitutes at the same time a driving device for the torsion element 3. The screen 611 is supported jointly with the swivelling lever 35 on the bearing bolt 350 so that when the torsion element 3 is swivelled, the swivelling of screen 611 prevents any relative movement from occurring between the torsion element 3 and the screen 611.

In normal spinning operation the torsion element 3 is in its spinning position I. The screen 611 is then in its left position (indicated by alternating dots and dashes in FIG. 3), in which it lays open gap 34. For piecing after yarn breakage (or immediately upon the occurrence of a yarn breakage) the solenoid 37 (FIG. 2) is excited and thus moves the screen 611 toward the torsion element 3. By being applied against the torsion element 3, the screen 611 covers the gap 34. As the swivelling movement is continued, the screen 611 serves as a driving device for the torsion element 3 and transfers it from its spinning position I into its threading position II (indicated by dashed lines in FIG. 3).

In such an embodiment of the sealing device 61, the gap 34 in the holding device 32, and thereby also the gap 33 between the injector nozzle 30 and the torsion element 31, is covered during the threading phase.

Figure 3:
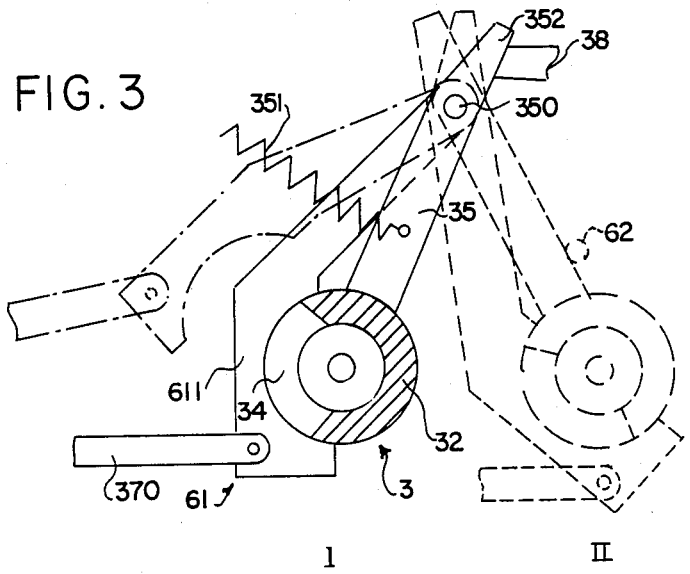
FIG. 3 is a top view of a variant of the spinning device shown in FIG. 2.

The threading position II of the torsion element 3 can be determined by appropriately sizing the stroke of the solenoid 37. However, it is also possible to associate additionally a stop 62 to the swivelling lever 35, determining the threading position II of the torsion element 3 (FIG. 3).

If desired, the swivelling movement of the screen 611 can also serve to control the stream of compressed air in the torsion element 3. The screen 611 can for example open or close the lines 322 and 323 in function of its position in relation to the torsion element 3. In the left end-position (indicated by alternating dots and dashes in FIG. 3), in which the screen 611 is lifted away from the torsion element 3, said screen 611 lays open the lines 322 and 323, so that the torsion element 3 is subjected to overpressure. When a yarn breakage occurs, the screen 611 is applied against the torsion element 3 and thus also interrupts the arrival of compressed air to said torsion element 3. The flow of compressed air to the torsion element 3 also remains suspended after threading of the yarn 10 into the torsion element 3, even if the latter has returned to its spinning position I. In synchronization with the release of the roving and with the resumption of yarn withdrawal by bobbin 51 and/or draw-off device 4, the flow of air to the torsion element 3 is also resumed through the return of the screen 611 into its starting position, indicated by alternating dots and dashes in the drawing.

FIGS. 4 and 5 represent an embodiment of the threading device 6 in which the injector nozzle 30 and the torsion nozzle 31 can be moved in relation to each other along their axis in such a manner that they are axially pressed against each other during the threading phase. In this embodiment, the torsion nozzle 31 is fixedly supported in the holding device 32, while the injector nozzle 30 can be moved in axial direction. For this purpose the injector nozzle 30 and the torsion nozzle 31 are provided with ring-shaped recesses 303 and 313 respectively around their spinning bores 302 and 312, on their sides facing each other, for the seating of a compression spring 324. Furthermore, a stop bolt 325 is supported in the holding device 32, said stop bolt 325 extending radially inward up to an oblong slit 304 on the outside of the injector nozzle 30. This oblong slit 304 limits the maximum extension of the compression spring 324 in one direction, and thus the movement of the injector nozzle away from the torsion nozzle 31, while it is of such length in the other direction as to allow complete contact between the ends of the injector nozzle 30 and the torsion nozzle 31 facing each other.

In the embodiment shown, on either side of the ring channel 320, the seal rings 326 and 327 are provided between the holding device 32 and the injector nozzle 30. In addition, the injector nozzle 30 is also equipped with a seal ring 328 on its side toward the suction pipe 6, said seal ring 328 interacting with the opening 600 of the suction pipe 60. An additional seal can be provided in one or both ends facing each other of the injector nozzle 30 and the torsion element 31.

When the torsion element 3 has been brought into its threading position II for the threading of the back-fed yarn 10, the suction pipe 60 is brought into its yarn receiving position in front of the end constituting the inlet 301 of the torsion element 3 during the normal spinning process, whereby it comes into sealing contact with the injector nozzle 30. The suction pipe 60 however continues its movement in direction of the injector nozzle 30, until the injector nozzle 30 is applied against the torsion nozzle 31, thus closing the gap 33 between them, while the compression spring 324 is tensed.

The yarn end is now sucked back through the torsion element 3 and into the suction pipe 60 in the manner described above, whereby the yarn 10 is released for this back-feeding to the suction pipe 60 through reverse rotation of the bobbin 51 or through the release of a previously constituted yarn reserve. Since extraneous air streams between the outlet side 311 of the torsion element 3, to which the back-fed yarn is presented, and the suction pipe 60 are eliminated, the full negative pressure prevailing within the suction pipe 60 acts also at the outlet side 311 of the torsion element 30, and this creates the necessary condition so that threading of the yarn 10 into the torsion element 3 to be effected with relatively weak negative pressure.

Another embodiment of the sealing device 61 is shown in FIG. 6. In this embodiment the holding device 32 of the torsion element 3 is equipped with a sleev-like screen 612 which surrounds said holding device 32 in the axial zone of the injector nozzle 30. The holding device 32 is provided with a ring shoulder 340 extending radially outward, in its zone facing gap 34 in the axial zone of the injector nozzle 30, while the screen 612, on its end facing the outlet side 301, is provided with a ring shoulder 613 extending radially inward and reaching up to the outer circumference of the holding device, while its inner circumference is otherwise equal to the outer circumference of the ring shoulder 340. A compression spring 614 is installed in the space thus formed between the ring shoulders 340 and 613.

The screen 612 is equipped, at its end facing the torsion nozzle 31, with an outer thread 615 on which is screwed a cap 616 which, under the pressure exerted upon it by the compression spring 614 via screen 612, is applied to the side of the ring shoulder 340 which faces the torsion nozzle 31 and which thus acts as a stop.

In its zone facing the gap 34, in the axial zone of the torsion nozzle 31, the holding device 32 is provided with a ring shoulder 341 with a ring-shaped recess 342 which receives a ring seal 342.

The force of the compression spring 614 holds the screen 612 and its cap 616 pressed against the ring shoulder 340 of the holder 32. When the torsion element 3 has been brought into its threading position II, the suction pipe 60 is associated to its outlet side 301 (see FIG. 2). This suction pipe 60 is then pressed against the screen 612 with such force that said screen 612 is applied against the ring seal 342, in opposition to the effect of the compression spring 614, thus sealing the gap 34 in the holding device 32.

Even if the closing of the gaps 33 or 34 has always been effected by the suction pipe 60 in the examples of embodiments described above through FIGS. 4 to 6, this is not necessarily the case in every instance. It is equally possible to bring about such an axial shifting of the torsion nozzle 31 or of a sleeve-like screen surrounding the torsion nozzle 31 (similar to 612) in the direction of the injector nozzle, whereby the drive can be constituted for example by a suction device (not shown) which accepts the yarn 10 from the bobbin 51, or by another component of the element constituting the yarn feed-back device. Opposite movements of the injector nozzle 30 and of the torsion nozzle 31, or of sleeves which surround these two nozzles 30 and 31 are also possible.

Neither is it necessary for the torsion element 3 to be supported on a swivelling lever 35, but it can be swivelled by means of a swivelling axle (not shown) on the torsion element 3 itself in such a manner that at least its inlet side 301 assumes a threading position II which is different from the spinning position I. Shifting of the torsion element 3 in a slide-like guide (not shown) can be provided, if desired. The kind of transfer from spinning position I to threading position II is therefore immaterial for the instant invention.

We claim:

1. Process for piecing to a spinning device following a yarn breakage, with a spinning device using a pneumatic torsion device equipped with an injector component which is separated from a downstream torsion component thereof with a gap open to the atmosphere, wherein the process includes that the yarn end is applied to the outlet opening of the pneumatic torsion device and is sucked back to the inlet side, and that the gap between the injector component and the torsion component is closed for such sucking-back and is reopened at the latest when subsequent draw-off of the pieced yarn begins.

2. Process as in claim 1, characterized in that the gap is closed by being covered.

3. Process as in claim 1, characterized in that the gap is closed through the transfer of the pneumatic torsion device into a threading position.

4. Process as in claim 1, characterized in that the gap is closed through the relative axial movement of the injector component and the torsion component.

5. Process as in claim 4, wherein such relative axial movement is effected by application to the pneumatic torsion device of a suction pipe used for threading.

6. Process as in claim 3, wherein closing of the gap through transfer of the pneumatic torsion device includes moving the gap against a stop member.

7. Process as in claim 3, wherein closing of the gap includes moving a stop member against the gap, movement of which continues thereafter for transferring the pneumatic torsion device into said threading position thereof.

8. Process as in claim 1, wherein closure of the gap includes providing an axially-movable sleeve-like member around the pneumatic torsion device, and selectively actuating movement of such sleeve-like member into an axial position thereof which surrounds and closes the gap.

9. A method of piecing up following a yarn breakage on a spinning device of the type having pneumatic torsion means with separate injector and torsion components which are axially-displaced from one another with a gap therebetween, said method comprising the steps of:

providing a controllable sealing means for selectively sealing said gap so that suction force applied to said pneumatic torsion means is fully applied to an outlet side thereof;

sensing a yarn breakage to re-apply a yarn end to such torsion means outlet side while applying suction force to such torsion means and while controlling said sealing means so as to seal said gap thereof, which fully applies said suction force to said torsion means outlet side; and subsequently drawing off pieced-up yarn from said torsion means while operating same for yarn spinning and while controlling said sealing means so as to open said gap thereof, which admits adequate air to said torsion means for yarn spinning operation thereof.

10. A spinning device of the type having pneumatic torsion means for spinning roving fed thereto into yarn, said device including an injector component and a torsion component downstream therefrom, said components collectively forming said torsion means, and defining a gap therebetween open to the atmosphere, and said device further including gap closing means for selectively closing said gap to the atmosphere during piecing operations of the device, during which piecing operations spinning operation of said torsion means is suspended and piecing suction is applied thereto for returning a yarn free end to said torsion means, wherein such gap closing enhances the effect of the piecing suction on such yarn free end by preventing escape of such piecing suction through the gap.

11. A spinning device as in claim 10, wherein said closing means includes a screen member adapted to be selectively associated with said gap.

12. A spinning device as in claim 11, wherein said pneumatic torsion means is associated with an elastic element by means of which it is held against a stop which determines the spinning position thereof, and said screen includes a driving device by means of which said pneumatic torsion means can be moved into a threading position thereof.

13. A spinning device as in claim 10, further comprising a stationary screen to which said gap can be brought through movement of said pneumatic torsion means from a spinning position thereof to a threading position thereof.

14. A spinning device as in claim 13, wherein said pneumatic torsion means is pivotably supported and adapted to be sealingly applied against said screen through swivelling around a swivelling axis thereof.

15. A spinning device as in claim 10, wherein said torsion component and said injector component are adapted to be brought axially into contact with each other during piecing operations to thereby seal said gap therebetween.

16. A spinning device as in claim 10, wherein said gap closing means includes a sleeve-like screen member, surrounding at least one of said components, and adapted to be axially brought into a position that seals said gap.

17. A spinning device as in claim 15, wherein an inlet side of said pneumatic torsion means is adapted to be actuated with a suction pipe for providing piecing suction in such manner that said gap is closed by controlled axial movement of at least one of said injector component and said torsion component.

18. A spinning device as in claim 16, wherein said sleeve-like screen member is adapted to be actuated with a suction pipe for providing piecing suction in such manner that said gap is closed by controlled axial movement of said sleeve-like screen member.

19. A spinning device, comprising:

drafting means for feeding roving to be spun into yarn;

pneumatic torsion means for accepting roving fed thereto from said drafting means, and spinning such roving into yarn during spinning operation of said torsion means, said torsion means including an upstream injector component on an inlet side thereof and a downstream torsion component on an outlet side thereof, said components defining an axially-situated gap therebetween;

draw-off means for controllably drawing off yarn produced by said torsion means during spinning operation thereof;

bobbin winding means for winding drawn-off thread onto a bobbin; and threading means for returning a free yarn end to said torsion means in a threading operation thereof after a yarn breakage while suspending said spinning operation thereof, said threading means including threading suction means for applying suction to said torsion means inlet side for retrieving the yarn free end thereinto through said outlet side thereof, and further including gap sealing means for sealing said gap defined between said torsion means components so that full effect of said suction applied to said torsion means inlet side is directed to said outlet side thereof during such threading operation.

* * * * *